US011155444B2

(12) United States Patent
Wang et al.

(10) Patent No.: US 11,155,444 B2
(45) Date of Patent: Oct. 26, 2021

(54) ELEVATOR DOOR INTERLOCK ASSEMBLY

(71) Applicant: OTIS ELEVATOR COMPANY, Farmington, CT (US)

(72) Inventors: Yunyi Wang, Florence, SC (US); Suresh Dharmaraj, Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 596 days.

(21) Appl. No.: 15/967,771

(22) Filed: May 1, 2018

(65) Prior Publication Data

US 2019/0337765 A1 Nov. 7, 2019

(51) Int. Cl.

| | |
|---|---|
| ***B66B 13/20*** | (2006.01) |
| ***B66B 13/12*** | (2006.01) |
| ***B66B 13/30*** | (2006.01) |

(52) U.S. Cl.

CPC ..... *B66B 13/20* (2013.01); *B66B 13/12* (2013.01); *B66B 13/30* (2013.01)

(58) Field of Classification Search

CPC ..... B66B 13/20; B66B 13/12; B66B 13/30
See application file for complete search history.

(56) References Cited

U.S. PATENT DOCUMENTS

| | | | | |
|---|---|---|---|---|
| 1,950,150 A | | 3/1934 | Norton et al. | |
| 3,315,767 A | | 4/1967 | Walter | |
| 3,638,762 A | * | 2/1972 | Johns | B66B 13/12 187/319 |
| 4,094,385 A | * | 6/1978 | Maeda | B66B 1/285 187/291 |
| 4,457,405 A | | 7/1984 | Johns | |
| 4,923,055 A | * | 5/1990 | Holland | B66B 1/32 187/287 |
| 5,089,355 A | | 2/1992 | Morita et al. | |
| 5,173,813 A | | 12/1992 | Haikawa et al. | |

(Continued)

FOREIGN PATENT DOCUMENTS

| | | |
|---|---|---|
| CN | 201610675 U | 10/2010 |
| CN | 204057608 U | 12/2014 |

(Continued)

OTHER PUBLICATIONS

Extended European Search Report for Application No. EP 19 17 2084 dated Mar. 18, 2020.

(Continued)

*Primary Examiner* — Michael A Riegelman
(74) *Attorney, Agent, or Firm* — Carlson, Gaskey & Olds

(57) ABSTRACT

An illustrative example elevator door interlock includes a base, a plurality of interlock bumpers supported on the base, and a latch supported on the base for movement relative to the base between a door locking position and a released position. The plurality of interlock bumpers are supported on the base with a gap between the plurality of interlock bumpers. Each of the interlock bumpers includes a contact surface configured to contact at least one vane supported on an elevator car door. Each of the interlock bumpers remains rotationally fixed relative to the base. The latch includes a latch bumper that is situated relative to the gap such that the at least one vane contacts the latch bumper and urges the latch into the released position when the at least one vane is at least partially in the gap.

6 Claims, 4 Drawing Sheets

(56) References Cited

U.S. PATENT DOCUMENTS

| | | | | |
|---|---|---|---|---|
| 5,538,106 | A * | 7/1996 | McHugh | B66B 13/12 187/330 |
| 5,651,427 | A * | 7/1997 | Kulak | B66B 13/12 187/330 |
| 5,651,428 | A * | 7/1997 | Ahigian | B66B 13/12 187/330 |
| 5,718,055 | A * | 2/1998 | Pierce | G01B 3/30 33/501.05 |
| 5,732,796 | A * | 3/1998 | Ahigian | B66B 13/12 187/314 |
| 5,959,266 | A * | 9/1999 | Uchiumi | B66B 1/30 187/292 |
| 6,089,355 | A * | 7/2000 | Seki | B66B 1/285 187/292 |
| 6,173,813 | B1 * | 1/2001 | Rebillard | B66B 5/06 187/287 |
| 6,446,759 | B1 * | 9/2002 | Kulak | B66B 13/12 187/319 |
| 6,474,448 | B1 | 11/2002 | Zappa | |
| 7,147,084 | B2 * | 12/2006 | Jahkonen | B66B 1/40 187/293 |
| 7,252,179 | B2 | 8/2007 | Oberleitner | |
| 7,350,623 | B2 * | 4/2008 | Kinoshita | B66B 13/12 187/319 |
| 7,398,862 | B2 * | 7/2008 | Dziwak | B66B 13/20 187/319 |
| 7,650,971 | B2 | 1/2010 | Pillin et al. | |
| 8,939,262 | B2 * | 1/2015 | Schienda | B66B 5/06 187/287 |
| 9,260,275 | B2 * | 2/2016 | Reuter | B66B 13/125 |
| 9,302,886 | B2 * | 4/2016 | Tantis | B66B 13/12 |
| 9,637,350 | B2 * | 5/2017 | Mittermayr | B66B 13/20 |
| 9,656,835 | B2 * | 5/2017 | Kitazawa | B66B 13/18 |
| 9,663,329 | B2 * | 5/2017 | Zappa | B66B 13/125 |
| 9,834,413 | B2 * | 12/2017 | Mittermayr | B66B 13/12 |
| 9,845,224 | B2 * | 12/2017 | Rasanen | E05D 15/0652 |
| 10,196,237 | B2 | 2/2019 | Kattainen et al. | |
| 2001/0003319 | A1 | 6/2001 | Itoh et al. | |
| 2012/0000729 | A1 * | 1/2012 | Marvin | B66B 5/044 187/287 |
| 2012/0000732 | A1 * | 1/2012 | Draper | B66B 5/06 187/373 |
| 2016/0145074 | A1 * | 5/2016 | Kattainen | B66B 1/285 187/254 |
| 2017/0190547 | A1 * | 7/2017 | Dharmaraj | B66B 13/30 |
| 2018/0079621 | A1 * | 3/2018 | Fauconnet | B66B 5/0087 |
| 2018/0118514 | A1 * | 5/2018 | Bruno | B66B 5/0012 |
| 2018/0229972 | A1 * | 8/2018 | Kulak | B66B 13/16 |
| 2018/0265334 | A1 * | 9/2018 | Kulak | B66B 13/12 |
| 2019/0337765 | A1 * | 11/2019 | Wang | B66B 13/30 |
| 2019/0337767 | A1 | 11/2019 | Tracey et al. | |
| 2019/0337768 | A1 * | 11/2019 | Kulak | B66B 19/00 |
| 2019/0337769 | A1 * | 11/2019 | Khzouz | B66B 13/20 |
| 2020/0115192 | A1 * | 4/2020 | Montigny | B66B 13/12 |

FOREIGN PATENT DOCUMENTS

| | | | |
|---|---|---|---|
| CN | 204369335 | U | 6/2015 |
| CN | 103693538 | B | 7/2015 |
| CN | 104773637 | A | 7/2015 |
| CN | 103693539 | B | 11/2015 |
| CN | 103803389 | B | 11/2015 |
| CN | 104176604 | B | 3/2016 |
| CN | 104444734 | B | 3/2016 |
| CN | 105645239 | A | 6/2016 |
| CN | 105936467 | A | 9/2016 |
| CN | 106006324 | A | 10/2016 |
| CN | 106044504 | A | 10/2016 |
| CN | 106081819 | A | 11/2016 |
| CN | 106081820 | A | 11/2016 |
| CN | 106395582 | A | 2/2017 |
| CN | 107176530 | A | 9/2017 |
| CN | 107614412 | A | 1/2018 |
| EP | 2426076 | A1 | 3/2012 |
| EP | 3048075 | B1 | 3/2018 |
| GB | 415931 | | 9/1934 |
| GB | 2358623 | A | 8/2001 |
| JP | H0812228 | | 1/1996 |
| JP | H10203742 | A | 8/1998 |
| JP | 2005008371 | | 1/2013 |
| WO | 2005/077808 | A2 | 8/2005 |
| WO | 2006/080094 | A1 | 8/2006 |
| WO | 2011/104818 | A1 | 9/2011 |
| WO | 2011/137545 | A1 | 11/2011 |
| WO | 2014/122358 | A1 | 8/2014 |
| WO | 2016/085678 | A1 | 6/2016 |
| WO | 2016/176033 | A1 | 11/2016 |
| WO | 2017/023927 | A1 | 2/2017 |
| WO | 2017/187560 | A1 | 11/2017 |

OTHER PUBLICATIONS

The Extended European Search Report for EP Application No. 19172106.7, dated Jan. 31, 2020.

Extended European Search Report for Application No. EP 19 17 2105 dated Sep. 27, 2019.

Extended European Search Report for Application No. EP 19 17 2040 dated Sep. 23, 2019.

Extended European Search Report for Application No. EP 19 17 2026 dated Sep. 5, 2019.

* cited by examiner

ELEVATOR DOOR INTERLOCK ASSEMBLY

BACKGROUND

Elevator systems are in widespread use for carrying passengers between various levels in buildings, for example. Access to an elevator car requires that elevator car doors open when the car is at a landing at which a passenger desires to board the elevator car, for example. Each landing includes hoistway doors that move with the elevator car doors between open and closed positions.

There are various known arrangements for coupling the elevator car doors to the hoistway doors so that the door mover that causes movement of the car doors also causes desired movement of the hoistway doors. Most door coupling arrangements include a set of vanes supported on the elevator car door structure and an interlock including rollers supported on the hoistway door structure. When the rollers are received adjacent the vanes, it is possible to move both doors together. The movement of the car doors includes one of the vanes pushing on one of the rollers to move the hoistway door in one direction and the other vane pushing on the other roller to move the hoistway door in the other direction.

It is believed that elevator door system components account for approximately 50% of elevator maintenance requests and 30% of callbacks. Almost half of the callbacks due to a door system malfunction are related to one of the interlock functions.

Another drawback associated with known interlock arrangements is that the components require space between the elevator car and the hoistway wall and that leads to an increase in a gap between the sills of the elevator car and the hoistway enclosure. This gap must be within a certain limit to meet code requirements in some locations. Proposals for reducing the gap have included adding components to the landing sill. Adding components for this purpose, however, increases cost and introduces additional potential sources of callbacks.

SUMMARY

An illustrative example elevator door interlock includes a base, a plurality of interlock bumpers supported on the base, and a latch supported on the base for movement relative to the base between a door locking position and a released position. The plurality of interlock bumpers are supported on the base with a gap between the plurality of interlock bumpers. Each of the interlock bumpers includes a contact surface configured to contact at least one vane supported on an elevator car door. Each of the interlock bumpers remains rotationally fixed relative to the base. The latch includes a latch bumper that is situated relative to the gap such that the at least one vane contacts the latch bumper and urges the latch into the released position when at least one vane is at least partially in the gap.

In an example embodiment having one or more features of the elevator door interlock of the previous paragraph, a first distance separates the latch bumper from a first one of the interlock bumpers when the latch is in the locking position, a second distance separates the latch bumper from the first one of the interlock bumpers when the latch is in the released position, the first distance is smaller than the second distance and the second distance is at least as large as the gap.

In an example embodiment having one or more features of the elevator door interlock of any of the previous paragraphs, the latch is situated relative to the gap when the latch is in the released position so that the latch does not carry any load associated with movement of an associated hoistway door.

In an example embodiment having one or more features of the elevator door interlock of any of the previous paragraphs, the latch comprises a flat plate, the latch includes a locking surface configured to engage a stop when the latch is in the locking position, and the latch comprises a weight near one end to bias the latch into the locking position.

In an example embodiment having one or more features of the elevator door interlock of any of the previous paragraphs, the base comprises a door hanger for a hoistway door.

An example embodiment having one or more features of the elevator door interlock of any of the previous paragraphs includes a switch that provides an indication whether the latch is in the locking position and the latch comprises a switch contact that cooperates with the switch when the latch is in the locking position and separated from the switch when the latch is in the released position.

An example embodiment having one or more features of the elevator door interlock of any of the previous paragraphs includes at least one bumper support secured to the base. The base comprises a flat surface, the at least one bumper support includes a plurality of surfaces that are perpendicular to the flat surface, the plurality of surfaces of the at least one bumper support respectively support one of the plurality of interlock bumpers, and a position of the bumpers relative to the respective bumper support surface is selectively adjustable.

Another illustrative example elevator door interlock includes a base, a plurality of interlock bumpers supported on the base with a gap between the plurality of interlock bumpers, and a latch supported on the base for movement relative to the base between a door locking position and a released position. Each of the interlock bumpers includes a contact surface configured to contact at least one vane supported on an elevator car door. The latch includes a latch bumper that is situated relative to the gap such that the at least one vane contacts the latch bumper and urges the latch into the released position when the at least one vane is at least partially in the gap. The latch bumper is situated relative to the gap when the latch is in the released position so that the latch does not carry any load associated with movement of an associated hoistway door.

In an example embodiment having one or more features of the elevator door interlock of any of the previous paragraphs, a first distance separates the latch bumper from a first one of the interlock bumpers when the latch is in the locking position, a second distance separates the latch bumper from the first one of the interlock bumpers when the latch is in the released position, the first distance is smaller than the second distance, and the second distance is at least as large as the gap.

In an example embodiment having one or more features of the elevator door interlock of any of the previous paragraphs, each of the interlock bumpers remains rotationally fixed relative to the base.

[owns] In an example embodiment having one or more features of the elevator door interlock of any of the previous paragraphs, the latch comprises a flat plate, the latch includes a locking surface configured to engage a stop when the latch is in the locking position, and the latch comprises a weight near one end to bias the latch into the locking position.

In an example embodiment having one or more features of the elevator door interlock of any of the previous paragraphs, the base comprises a door hanger for a hoistway door.

An example embodiment having one or more features of the elevator door interlock of any of the previous paragraphs includes a switch that provides an indication whether the latch is in the locking position and wherein the latch comprises a switch contact that cooperates with the switch when the latch is in the locking position and the switch contact is separated from the switch when the latch is in the released position.

An example embodiment having one or more features of the elevator door interlock of any of the previous paragraphs includes at least one bumper support secured to the base. The base comprises a flat surface, the at least one bumper support includes a plurality of surfaces that are perpendicular to the flat surface, the plurality of surfaces of the at least one bumper support respectively support one of the plurality of interlock bumpers, and a position of the bumpers relative to the respective bumper support surface is selectively adjustable.

An illustrative example elevator door assembly includes at least one elevator car door, at least one vane situated for movement with the elevator car door, at least one hoistway door, a base supported for movement with the hoistway door, a plurality of interlock bumpers supported on the base with a gap between the plurality of interlock bumpers, and a latch supported on the base for movement relative to the base between a door locking position and a released position. Each of the interlock bumpers includes a contact surface configured to contact the vane when the elevator car door is adjacent the hoistway door. The interlock bumpers remain rotationally fixed relative to the base. The latch includes a latch bumper that is situated relative to the gap such that the vane contacts the latch bumper and urges the latch into the released position as the elevator car door approaches the hoistway door. The latch does not carry any load associated with lateral movement of the hoistway door caused by engagement between the vane and any of the plurality of interlock bumpers.

In an example embodiment having one or more features of the elevator door assembly of any of the previous paragraphs, a first distance separates the latch bumper from a first one of the interlock bumpers when the latch is in the locking position, a second distance separates the latch bumper from the first one of the interlock bumpers when the latch is in the released position, the first distance is smaller than the second distance, and the second distance is at least as large as the gap.

In an example embodiment having one or more features of the elevator door assembly of any of the previous paragraphs, the latch comprises a flat surface, the latch includes a locking surface configured to engage a stop when the latch is in the locking position, and the latch comprises a weight near one end to bias the latch into the locking position.

In an example embodiment having one or more features of the elevator door assembly of any of the previous paragraphs, the base comprises a door hanger of the hoistway door.

An example embodiment having one or more features of the elevator door assembly of any of the previous paragraphs includes a switch that provides an indication whether the latch is in the locking position and wherein the latch comprises a switch contact that cooperates with the switch when the latch is in the locking position and the switch contact is separated from the switch when the latch is in the released position.

An example embodiment having one or more features of the elevator door assembly of any of the previous paragraphs includes at least one bumper support secured to the base, the base comprises a flat surface, the at least one bumper support includes a plurality of surfaces that are perpendicular to the flat surface, the plurality of surfaces of the at least one bumper support respectively support one of the plurality of interlock bumpers, and a position of the bumpers relative to the respective bumper support surface is selectively adjustable.

The various features and advantages of an example embodiment will become apparent to those skilled in the art from the following detailed description. The drawings that accompany the detailed description can be briefly described as follows.

DETAILED DESCRIPTION

Embodiments of this invention provide an elevator door interlock that requires less space compared to previous interlock designs. By reducing the amount of space required by the interlock, it becomes possible to reduce the amount of space needed between the elevator car and the hoistway wall. Additionally, the gap between the elevator car door sill and the landing door panel can be reduced compared to other interlock configurations.

Embodiments of this invention separate the door unlocking and door moving functions. In previous interlocks, a roller used to unlock the door lock also carried a significant portion of the load associated with opening the hoistway door. By separating the unlocking and door moving functions, the latch of the interlock does not need to bear the load associated with opening the hoistway door, which can contribute to realizing a thinner interlock.

Additionally, embodiments of this invention reduce costs associated with the interlock assembly and field installation. Maintenance costs are lower because example embodiments reduce the likelihood for costs associated with callbacks based on interlock problems or malfunction.

Figure 1:
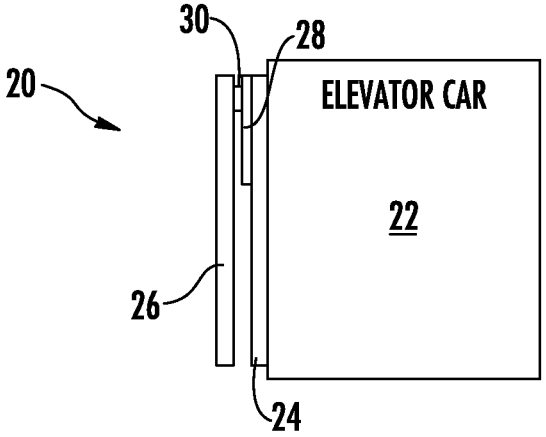
FIG. 1 schematically illustrates selected portions of an elevator system including a door interlock designed according to an embodiment of this invention.

FIG. 1 schematically illustrates selected portions of an elevator system 20 in side view. An elevator car 22 includes car doors 24 that are situated adjacent hoistway landing doors 26 when the elevator car 22 is parked at a landing. At least one vane 28 associated with the elevator car doors 24 cooperates with an interlock 30 associated with the hoistway doors 26 so that the elevator car doors 24 and the hoistway doors 26 move together between opened and closed positions.

Figure 2:
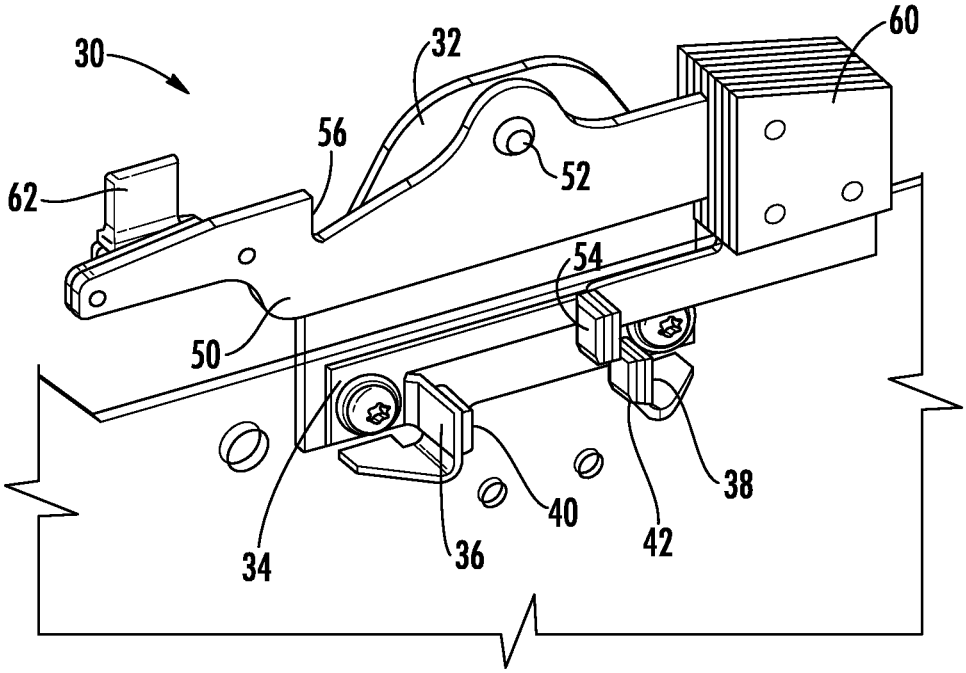
FIG. 2 is a perspective illustration that diagrammatically shows an example elevator door interlock designed according to an embodiment of this invention.
Figure 3:
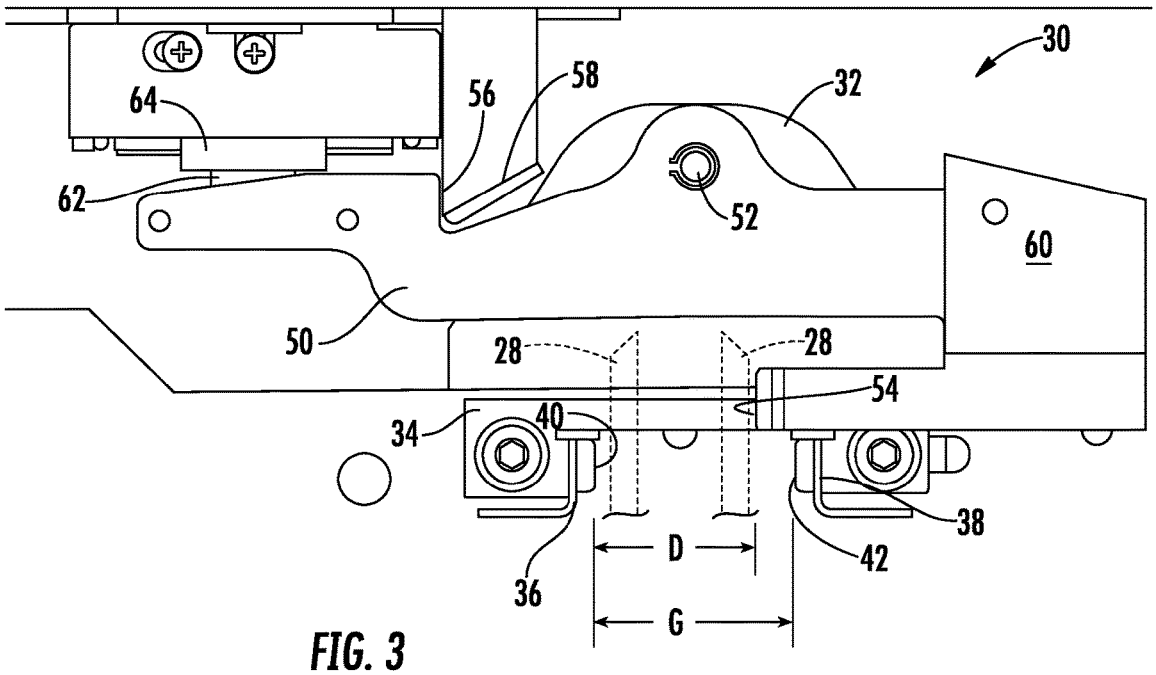
FIG. 3 diagrammatically illustrates a first condition of the example interlock of FIG. 2.
Figure 4:
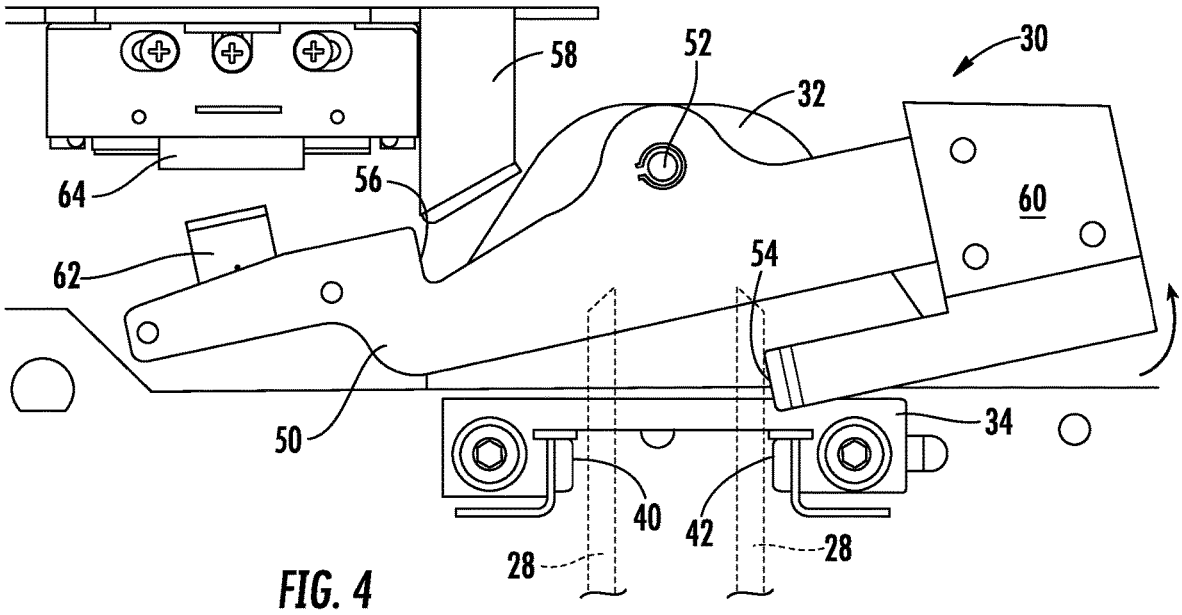
FIG. 4 diagrammatically illustrates a second condition of the example interlock.

FIGS. 2-4 show the interlock 30 of an example embodiment. The interlock 30 includes a base 32. In this example, the base 32 is configured to be secured to a portion of a hoistway door 26, such as a hanger of the hoistway door 26. In other embodiments, such as the one shown in FIG. 7, the hoistway door hanger serves as the base 32. The base 32 comprises a single flat plate in this example. At least one bumper support 34 is secured to the base 32. In the illustrated example, the bumper support 34 comprises a single angle bracket that includes surfaces 36 and 38 that are oriented generally perpendicular to the base 32. The surfaces 36 and 38 respectively support interlock bumpers 40 and 42 that are configured for making contact with at least one vane 28 associated with the elevator car door 24. The interlock bumpers 40 and 42 include contact surfaces facing in a direction to make contact with the vane 28.

One difference between the example interlock 30 and previous interlock arrangements is that the bumpers 40 and 42 remain rotationally fixed relative to the base 32. Previous interlock arrangements typically included rollers that rotated relative to the hoistway door or associated components of the interlock. By eliminating rollers, the example embodiment reduces the potential for noise associated with interlock operation. By remaining rotationally fixed relative to the base 32 during engagement with the vanes 28 and while the doors 24 and 26 open or close, the bumpers 40 and 42 provide a simpler, less expensive and more reliable arrangement than previous interlock designs. Depending on the material selected for the bumpers 40 and 42, there may be some deflection of the material, which may be considered relative movement between the bumpers 40 and 42 (or at least their contact surfaces) and the base 32, however, such movement is not the same as rotational movement associated with a roller.

The interlock 30 includes a latch 50 supported by the base 32 so that the latch 50 is moveable between a locking position (shown in FIG. 3) and a released position (shown in FIG. 4). In this example, the latch 50 pivots about a bearing 52 that secures the latch 50 to the base 32.

The latch 50 includes a latch bumper 54 that is configured to be contacted by a vane 28 as the elevator car doors 24 approach the hoistway doors 26. When the latch 50 is in the locking position as shown in FIG. 3, for example, a distance D between the latch bumper 54 and the interlock bumper 40 is smaller than a distance of a gap G between the interlock bumpers 40 and 42. As the vane or vanes 28 are received within the gap between the interlock bumpers 40 and 42, at least one vane 28 contacts the latch bumper 54 and urges it in a direction that causes movement of the latch 50 from the locking position toward the released position. As can be appreciated from FIG. 4, the latch bumper 54 moves into a position relative to the gap G so that the latch 50 does not carry any load associated with movement of the hoistway door 26. As the door moves in an open direction (to the right according to FIGS. 3 and 4), the vane 28 acts against the interlock bumper 42 and the latch 50 is not required to carry any of the load associated with movement of the door 26. As the doors move back toward a closed position (to the left according to FIGS. 3 and 4), the vane 28 acts against the interlock bumper 40.

By separating the locking and moving functions and eliminating the requirement that the latch 50 carry any load associated with moving the hoistway door 26, the latch 50 can be thinner. In the illustrated example, the latch 50 comprises a single flat plate. A thinner latch 50 contributes to reducing the space needed to accommodate the interlock 30 in a hoistway. Another feature of separating the locking and moving functions is that the bearing and latch connection can be simplified and less expensive compared to previous latch configurations, which saves cost and reduces the complexity of the interlock.

In the illustrated example a locking surface 56 on the latch 50 engages a stop 58 that is secured in a fixed position at a landing when the latch 50 is in the locking position so that the hoistway doors 26 cannot open when the latch 50 is in the locking position. In the released position shown in FIG. 4, the locking surface 56 is clear of the stop 58 and the door 26 is free to move. The illustrated example includes a weight 60 comprising a plurality of flat plates near one end of the latch 50 that biases the latch 50 into the locking position. Other weight configurations are included in other embodiments.

The illustrated example includes a switch contact 62 near one end of the latch 50. The switch contact 62 cooperates with a switch 64 that provides an indication when the latch 50 is in the locking position, which corresponds to the hoistway door 26 being locked. In the released position, the switch contact 62 does not make any contact with any portion of the switch 64, which provides an indication that the door is unlocked.

Figure 5:
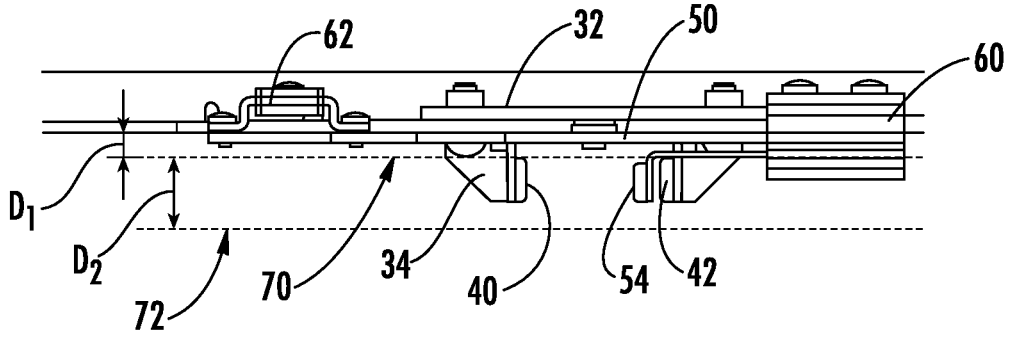
FIG. 5 is a top view of the example interlock showing dimensional features of the illustrated embodiment.
Figure 6:
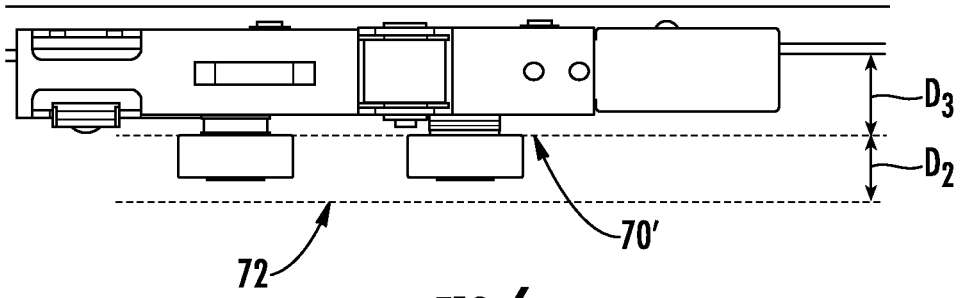
FIG. 6 PRIOR ART
FIG. 6 is a top view of a prior art interlock showing corresponding dimensional features of that interlock for comparison with FIG. 5.

Using flat plates for the latch 50 and the base 32, for example, allows for making a thinner interlock that requires less space and allows for the elevator door 24 to be closer to the hoistway door 26 and the hoistway wall because less clearance is required between them to accommodate components of the interlock. FIGS. 5 and 6 illustrate the type of space savings that are possible with embodiments of this invention. As shown in FIG. 5, a distance $D_1$ exists between the backside of the hoistway door hanger and the entrance sill line represented at 70. A second distance $D_2$ represents the gap that exists between the entrance or landing sill line and the elevator car sill line represented at 72. With embodiments of this invention, the distance $D_1$ may be less than 10 mm. In one example embodiment, $D_1$ is 8 mm. The distance $D_2$ will be on the order of 25 mm to accommodate a typical elevator car door vane size.

By contrast, a conventional interlock shown in FIG. 6 includes a larger distance $D_3$ between the back of the hanger plate and the entrance or landing sill line represented at 70'. The distance $D_2$ in FIG. 6 is the same 25 mm as the distance $D_2$ in FIG. 5 because the same car door vane configuration can be used. Comparing $D_1$ to $D_3$, the example embodiment of FIGS. 1-5 provides a 75% reduction in the distance between the back of the hoistway door hanger and the entrance or landing sill line. For example, $D_3$ is typically more than 30 mm while $D_1$ is less than 10 mm. The overall dimension $D_1+D_2$ is at least 30% thinner than the overall dimension $D_3+D_2$. In one example embodiment, a 36% reduction in the corresponding amount of space required between the elevator car doors 24 and the hoistway doors 26 may be achieved. Such space savings provide other advantages such as reducing or eliminating a need for fascia to cover spacing between the landing sill and the hoistway wall.

Figure 7:
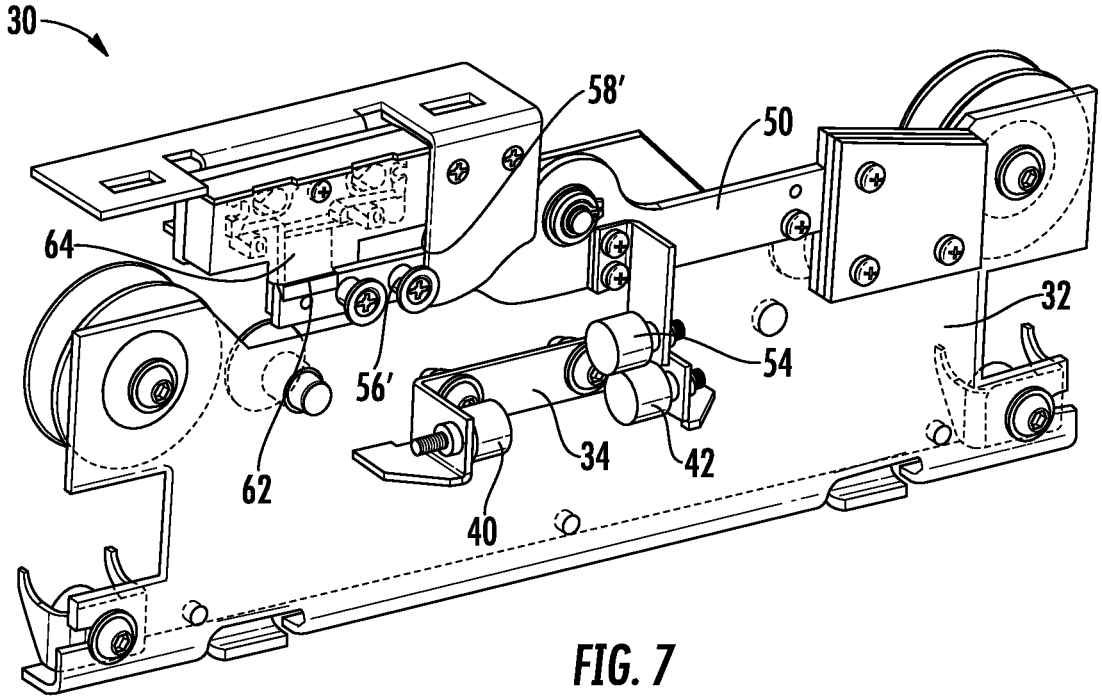
FIG. 7 diagrammatically illustrates another example elevator door interlock designed according to an embodiment of this invention.

FIG. 7 shows another example embodiment of an interlock designed according to an embodiment of this invention. In this example, the door hanger of the hoistway door 24 serves as the base 32. The door hanger in this example serves additional functions beyond simply hanging the door, for example, by providing the locations and support for the interlock components. The bumper support 34 is mounted directly to the hanger 32 and the latch 50 is supported to pivot or rotate relative to the hanger 32. In this example, the interlock 30 components can be preassembled to the door hanger prior to delivery to the site of the elevator system, which saves time and reduces errors during installation of the elevator system.

In this embodiment the door lock includes a stop 58' and the latch includes a locking surface 56' that engages the stop 58' in the locking position shown in FIG. 7. Mounting the door lock and the latch 50 to the door hanger eliminates any need to adjust relative positions of those components, which saves time during installation and reduces the possibility of misalignment of the switch 64 and the switch contact 62.

The interlock bumpers 40 and 42 are adjustable relative to the bumper support 34 to adjust a lateral position of the interlock bumpers 40 and 42 relative to the hoistway door 26. In this example the interlock bumpers 40 and 42 are supported on threaded rods that are received in threaded openings in the bumper support 34. Rotating the bumpers 40, 42 and their respective rods allows for changing the position of each bumper independently. The bumper positions should be set to accommodate the vanes 28 by setting the gap between the bumpers 40 and 42 and aligning the bumpers with the position of the vanes 28. The adjustable positions of the interlock bumpers 40 and 42 relative to the door hanger makes it easier for a technician to achieve alignment between the vanes 28 on the elevator car doors and all interlocks 30' along the hoistway without requiring any relative adjustments between the latch 50 and the switch 64.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator door assembly, comprising:

at least one elevator car door having an associated elevator car sill line;

at least one vane situated for movement with the elevator car door;

at least one hoistway door having an associated landing sill line;

a base supported for movement with the hoistway door;

a plurality of interlock bumpers supported on the base with a gap between the plurality of interlock bumpers, each of the interlock bumpers including a contact surface configured to contact the vane when the elevator car door is adjacent the hoistway door, the interlock bumpers remaining rotationally fixed relative to the base; and a latch comprising a single flat plate supported on the base for movement relative to the base between a door locking position and a released position, the latch including a latch bumper that is situated relative to the gap such that the vane contacts the latch bumper and urges the latch into the released position as the elevator car door approaches the hoistway door, wherein the latch does not carry any load associated with lateral movement of the hoistway door caused by engagement between the vane and any of the plurality of interlock bumpers, wherein a first gap exists along a first horizontal distance between a side of the base and the landing sill line;

a second gap exists along a second horizontal distance between the landing sill line and the elevator car sill line; and the first horizontal distance is less than one-half the second horizontal distance.

2. The elevator door assembly of claim 1, wherein a first distance separates the latch bumper from a first one of the interlock bumpers when the latch is in the locking position;

a second distance separates the latch bumper from the first one of the interlock bumpers when the latch is in the released position;

the first distance is smaller than the second distance; and the second distance is at least as large as the gap.

3. The elevator door assembly of claim 1, wherein the latch includes a locking surface configured to engage a stop when the latch is in the locking position;

the latch comprises a weight near one end to bias the latch into the locking position;

the latch comprises a switch contact near an opposite end of the latch; and the single flat plate has oppositely facing planar surfaces that are parallel to each other along an entire length of the latch between the weight and the switch contact.

4. The elevator door assembly of claim 3, wherein the base comprises a door hanger of the hoistway door.

5. The elevator door assembly of claim 1, comprising a switch that provides an indication whether the latch is in the locking position and wherein the latch comprises a switch contact that cooperates with the switch when the latch is in the locking position and the switch contact is separated from the switch when the latch is in the released position.

6. The elevator door assembly of claim 1, comprising at least one bumper support secured to the base, and wherein the base comprises a flat surface;

the at least one bumper support includes a plurality of surfaces that are perpendicular to the flat surface;

the plurality of surfaces of the at least one bumper support respectively support one of the plurality of interlock bumpers; and a position of the bumpers relative to the respective bumper support surface is selectively adjustable.

* * * * *